US008721065B2

(12) United States Patent
Ishitoya et al.

(10) Patent No.: US 8,721,065 B2
(45) Date of Patent: May 13, 2014

(54) INK JET PRINTER AND PRINTING METHOD

(75) Inventors: Mitsuaki Ishitoya, Ibaraki-ken (JP); Kenji Oshima, Ibaraki-ken (JP); Shoichi Miyata, Ibaraki-ken (JP)

(73) Assignee: Riso Kagaku Corporation, Minato-Ku, Tokyo (JP)

( * ) Notice: Subject to any disclaimer, the term of this patent is extended or adjusted under 35 U.S.C. 154(b) by 778 days.

(21) Appl. No.: 12/084,578

(22) PCT Filed: Oct. 25, 2006

(86) PCT No.: PCT/JP2006/321261

§ 371 (c)(1),
(2), (4) Date: May 6, 2008

(87) PCT Pub. No.: WO2007/052513

PCT Pub. Date: May 10, 2007

(65) Prior Publication Data

US 2009/0231389 A1 Sep. 17, 2009

(30) Foreign Application Priority Data

Nov. 7, 2005 (JP) ..... 2005-322941

(51) Int. Cl.

| | |
|---|---|
| ***B41J 2/15*** | (2006.01) |
| ***B41J 2/155*** | (2006.01) |
| ***B41J 2/21*** | (2006.01) |
| ***B41J 2/01*** | (2006.01) |

(52) U.S. Cl.

USPC ..... 347/104; 347/42; 347/43; 347/102

(58) Field of Classification Search

USPC ..... 347/40, 42, 43, 101, 102, 104

See application file for complete search history.

(56) References Cited

U.S. PATENT DOCUMENTS

| | | | | |
|---|---|---|---|---|
| 5,225,853 | A * | 7/1993 | Kobayashi et al. | 347/33 |
| 5,587,730 | A * | 12/1996 | Karz | 347/43 |
| 2002/0044187 | A1* | 4/2002 | Koitabashi et al. | 347/101 |
| 2004/0179055 | A1 | 9/2004 | Kawauchi et al. | |
| 2006/0023021 | A1* | 2/2006 | Shimizu | 347/34 |

FOREIGN PATENT DOCUMENTS

| | | |
|---|---|---|
| EP | 0 376 309 A2 | 7/1990 |
| JP | 63-277148 | 11/1988 |

(Continued)

*Primary Examiner* — Alessandro Amari
*Assistant Examiner* — Kendrick Liu
(74) *Attorney, Agent, or Firm* — Nath, Goldberg & Meyer; Jerald L. Meyer

(57) ABSTRACT

An ink jet printer comprising a conveyor belt unit 106 for transferring a print sheet 2 on a rotating conveyor belt 106*a*, a resist roller pair 111 and a BU roller 112 for feeding the print sheet 2 while flexing it in the transferring direction, and first and second ink jet head 104*a*, 104*b* for ejecting ink toward the print sheet, wherein the ink jet head 104*b* ejects ink darker in color than ink ejected from the ink jet head 104*a*. The ink jet head 104*b* serves to eject ink, that is darker in color than that of the ink jet head 104*a*, and is located at a position farther than the arriving position of the print sheet 2 when the print sheet 2 is displaced from the conveyor belt 106*a* in the transferring direction as the elasticity of the print sheet 2 due to flexure exceeds adhesion between the print sheet 2 and the conveyor belt 106*a*, while the ink jet head 104*a* is arranged between the ink jet head 104*b* and the BU roller 112. By this configuration, print quality can be sustained with high speed printing by using an ink jet head and reduction in printer size achieved.

12 Claims, 8 Drawing Sheets

(56) References Cited

FOREIGN PATENT DOCUMENTS

| | | | | | |
|---|---|---|---|---|---|
| JP | 09-204083 | | 8/1997 | | |
| JP | 10-194530 | | 7/1998 | | |
| JP | 2000086010 | A * | 3/2000 | ..... | B65H 7/02 |
| JP | 2000-159384 | | 6/2000 | | |
| JP | 2004-276486 | | 10/2004 | | |
| JP | 2005111944 | A * | 4/2005 | ..... | B41J 2/175 |

* cited by examiner (a)

(b)

(c)

(a)

(b)

(a)

(b)

INK JET PRINTER AND PRINTING METHOD

FIELD OF THE INVENTION

The present invention relates to an ink jet printer and a printing method in which a plurality of inks are ejected from ink jet heads in order on a print sheet transferred along a transfer path.

BACKGROUND ART

In the past, a printing method has been known in which color inks are ejected on a print sheet from a plurality of ink jet heads for different colors aligned in order along a transfer path formed by a high-speed conveyor belt. Recently, with increased demand for high-speed printing, this type of printing system is equipped with a conveyor belt that runs around the path at a high speed. This type of printing system equipped with a high-speed conveyor belt transfers a print sheet (print paper) from a paper feed unit to the line type ink jet heads by the conveyor belt running around at a high speed, performs printing on the print sheet which is passing through a transfer path, and discharges the print sheet as printed from a discharge unit (refer to Patent Document 1).

Incidentally, in the case of the configuration disclosed in the above Patent Document 1, a print sheet is sometimes obliquely transferred in relation to the transfer direction of the print sheet during transferring the print sheet from the paper feed unit to the ink jet heads, as called oblique transfer. Because of this oblique transfer, the position of the print sheet may be misaligned in relation to the ink jet heads to apply an excessive tension to the print sheet resulting in wrinkles or fracture.

Because of this, in the past, it was proposed to give an extra length to the print sheet by warping the print sheet when feeding the print sheet to the transfer path from the paper feed unit, regulate the arriving direction by the elastic force of the warping and absorb or release excessive tension acting on the print sheet.

However, in the case of this mechanism to warp the print sheet as described above, the elastic force of warping may become excessive depending upon the size, thickness or material of the print sheet to displace the print sheet in relation to the conveyor belt. If printing is started in this condition, the print position is misaligned to degrade the printing quality. As a design method for avoiding the above shortcoming, it may be conceived to place no ink jet head in the area where the print sheet may be displaced. However, in this case, the distance between the paper feed unit and the ink jet head becomes too large, resulting in a bigger design. [Patent Document 1] Japanese Patent Published Application No. 2004-276486

DISCLOSURE OF THE INVENTION

Taking into consideration the above circumstances, it is an object of the present invention to provide an ink jet printer and a printing method capable of maintaining the printing quality while realizing high-speed printing by the use of ink jet heads and miniaturizing the device.

In order to accomplish the object as described above, in accordance with the present invention, there are provided a conveyor belt unit including a rotating conveyor belt which serves to form a transfer path of a print sheet; a feed unit configured to warp the print sheet in the(a) transfer direction and feed the print sheet onto the transfer path; and a first and a second ink jet head disposed along the transfer path in succession and configured to perform ink ejection on the print sheet passing through the transfer path.

Particularly, the above second ink jet head of the present invention is configured to eject an ink which is darker in color than that of the first ink jet head, and located at a position farther than the arriving position of the print sheet when elastic force of the warping of the print sheet is greater than adherence between the print sheet and the conveyor belt, and the print sheet becomes misaligned from the conveyor belt in the transfer direction, while the first ink jet head is located between the second ink jet head and the feed unit.

Also, an ink jet printing method in accordance with the present invention can be performed by the use of such an ink jet printer. Namely, the ink jet printing method comprises: warping and feeding the print sheet onto a transfer path which is formed by a rotating conveyor belt; ejecting ink on the print sheet passing through the transfer path from a first ink jet head; and ejecting ink on the print sheet passing through the transfer path from a second ink jet head, wherein the second ink jet head ejects an ink which is darker in color than that of the first ink jet head. In addition to this, in accordance with the present invention, the second ink jet head is located at a position farther than the arriving position of the print sheet when elastic force of the warping of the print sheet is greater than adherence between the print sheet and the conveyor belt, and the print sheet becomes misaligned from the conveyor belt in the transfer direction.

In accordance with the present invention as described above, it is possible to prevent the damage or the like of the print sheet while realizing the high-speed printing, since the transfer direction is corrected by warping the print sheet and then absorbing or releasing the tension acting on the print sheet. More specifically, in the case where a plurality of rollers are arranged, it is difficult to assemble these rollers absolutely in parallel due to limitation of accuracy of the assembly, such that the print sheet slides in the transfer direction because the rollers are not parallel. Thereby, it is possible to correct the transfer direction by warping the print sheet between the plurality of rollers and absorbing or releasing the tension acting on the print sheet.

Also, in accordance with the present invention, since the second ink jet head configured to eject an ink which is darker in color than that of the first ink jet head is located at a position farther than the arriving position of the print sheet, even when elastic force of the warping of the print sheet is greater than adherence between the print sheet and the conveyor belt, and the print sheet becomes misaligned from the conveyor belt in the transfer direction, only a light-colored ink ejected by the first ink jet head is influenced by the misalignment but dark-colored ink is not influenced so that it is possible to minimize debasement of the quality of printing. Furthermore, in accordance with the present invention, it is possible to miniaturize the device since the paper feed unit is put closer to the first ink jet head unit.

Incidentally, in the case of the above invention, it is preferred that the feed unit comprises two pairs of rollers which are arranged along the transfer direction, and serves to warp the print sheet by the differential circumferential speed between the two roller pairs. In this case, when the print sheet is fed to the transfer path by the two roller pairs, the print sheet can surely be warped, for example, by setting the circumferential speed of the roller pair on downstream side to a lower speed.

BEST MODE FOR CARRYING OUT THE INVENTION

Figure 1:
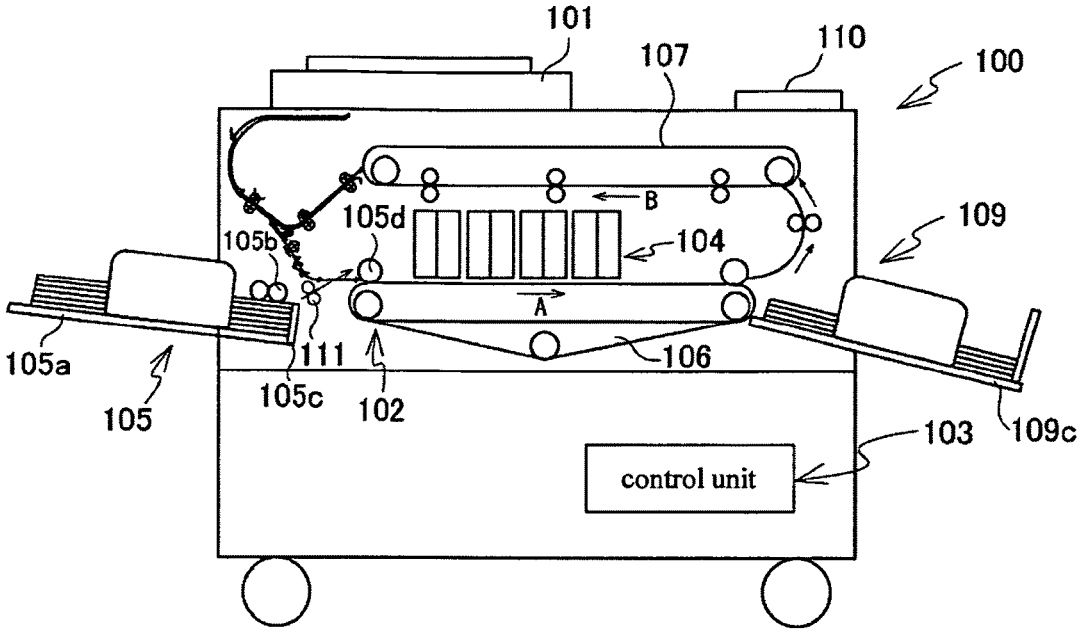
FIG. 1 is an explanatory view for schematically showing the configuration of an ink jet printer in accordance with an embodiment.
Figure 1:
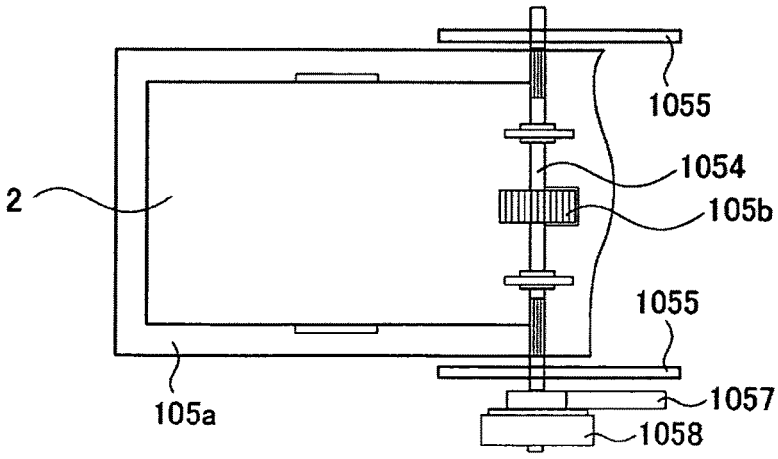
Figure 1:
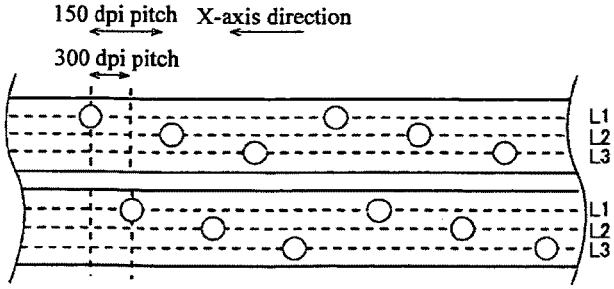
Figure 2:
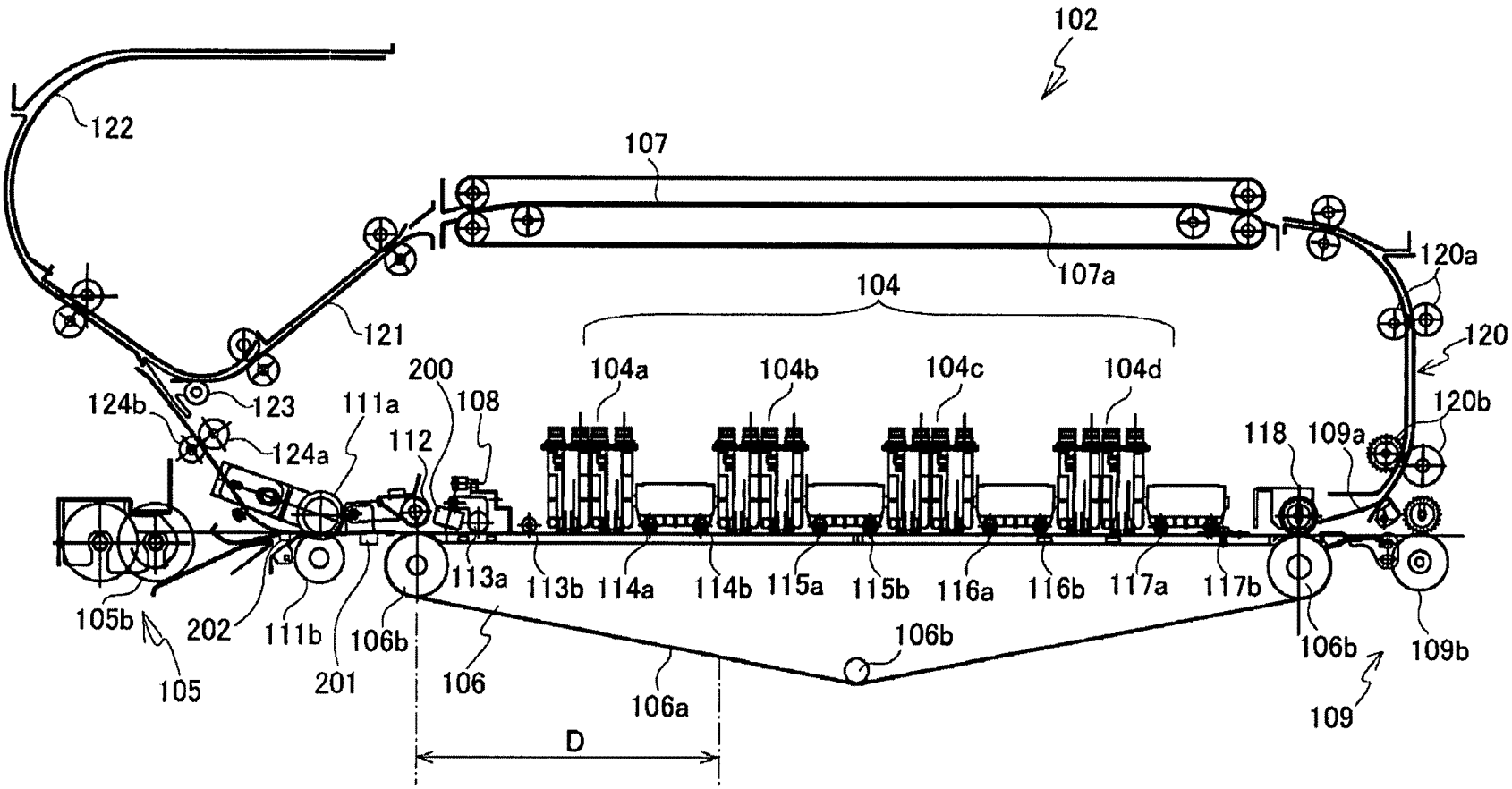
FIG. 2 is a side view showing the structure of a printing unit of the ink jet printer in accordance with the embodiment and the peripheral structure thereof in detail.

An embodiment of the present invention will be explained with reference to the accompanying drawings. FIG. 1 is an explanatory view for schematically showing the structure and print process of an ink jet printer in accordance with the present invention. FIG. 2 is a side view showing the structure of a printing unit 102 of the ink jet printer 100 and the peripheral structure thereof in detail.

(Structure of the Ink Jet Printer)

The ink jet printer 100 comprises: as shown in FIG. 1(*a*), an image reading unit 101 on an upper portion of the machine body; a printing unit 102 which performs printing inside the machine body; a paper feed unit 105 which feeds print sheets to the printing unit 102; a sheet discharging unit 109 which discharges the printed print sheets; a control unit 103 which controls operations of these units; and a touch panel 110 through which predetermined instructions, such as print instruction, are input. Each unit is described below in detail.

(Paper Feed Unit)

The paper feed unit 105, which has a paper feed tray 105*a*; a paper feed roller 105*b*; and a resist roller pair 111, is a module to stock the print sheets and feed the print sheets to the print unit 102 one sheet at a time.

The paper feed tray 105*a* on which a number of print sheets 2 are piled up is driven in an up-and-down direction by a driving unit (not shown in the figure). In the front of the paper feed tray 105*a* in a transfer direction of the print sheets, there is provided a front blocking wall 105*c* in a standing manner for positioning leading ends of the print sheets piled up the paper feed tray 105*a*.

Above the front blocking wall 105*c*, there is provided the paper feed roller 105*b* made of rubber or similar material. As shown in FIG. 1(*b*), this paper feed roller 105*b* is rotatably mounted by a support shaft 1054 between side plates 1055 and 1055 for drawing the print sheets one by one from the paper feed tray 105*a*. The support shaft 1054 is connected, at one end thereof, to a driven side of an electromagnetic clutch 1058, of which driving side is connected to a drive transmission belt 1057. The support shaft 1054 is driven to rotate only when the electromagnetic clutch 1058 is energized, i.e., when the driven and driving sides of the electromagnetic clutch 1058 are engaged.

The timing of rotating the support shaft 1054 is determined by a print timing sensor 201 and a paper feed timing sensor 202. The print timing sensor 201 and the paper feed timing sensor 202 cooperatively work to detect leading and trailing ends of the print sheet, and send the detected result to the control unit 103. The control unit 103 performs an operation to obtain the position of the print sheet with reference to the detected result, and then determines the timing of feeding the next paper sheet with reference to the result of the operation. The paper feed roller 105*b* is thereby rotationally driven when the electromagnetic clutch 1058 is being engaged.

On the other hand, at the upper end of the front blocking wall 105*c*, there is provided a paper separation pad holder (not shown in the figure) opposite the paper feed roller 105*b*. The paper separation pad holder (not shown) is supported by a bracket such that it can move in a radial direction of the paper feed roller 105*b* and biased to the outer peripheral surface of the paper feed roller 105*b* by spring force of a compression coil spring. On the upper surface of the paper separation pad holder (not shown), i.e., on the surface of the paper feed roller 105*b* opposite the outer peripheral surface of the paper feed roller 105*b*, there is provided a paper separation pad (not shown) made of rubber or rubber-like material, cork or the like having a relatively large friction coefficient.

In the forward direction of transmitting print sheets as seen from the paper feed roller 105*b*, i.e., on the ink jet head side, there is provided a paper feed path comprising a lower guide plate and an upper guide plate. The paper feed path continues from the paper feed roller 105*b* toward an ink jet head unit 104, Near the end of the paper feed path, there are provided a resist roller pair 111 comprising an upper and a lower resist rollers. The resist rollers 111*a* and 111*b* are in contact with each other at their outer peripheral surfaces, and the resist roller 111*b* is configured to be driven to rotate intermittently by a driving unit (not shown in the figure).

To allow deformation of the print sheet 2 in its transfer direction between the paper feed roller 105*b* and the resist roller pair 111, the upper guide plate is arched upward, and the paper feed path extends upward and downward just before the resist roller pair 111. Incidentally, the paper feed timing sensor 202 is provided just before the contact position between resist rollers 111*a* and 111*b* forming the resist roller pair 111, and the print timing sensor 201 is provided between the resist roller pair 111 and a conveyor belt roller 106*b* described below. The print timing sensor 201 and the paper feed timing sensor 202 cooperatively work to detect the ends of the print sheets. The resist roller pair 111 is provided for the purpose of positioning the end of the print sheet drawn by the paper feed roller 105*b*.

(Transfer Unit)

The conveyor belt unit 106 has a loop-like conveyor belt 106*a* which can run around, the conveyor belt rollers 106*b* which drive the conveyor belt 106*a* to run around, a drawing unit (not shown in the figure), a transfer drive unit (not shown in the figure), a print sheet transfer mechanism roller (SS roller) 113*a*, and a transfer roller (BU roller) 112.

The conveyor belt 106*a* and the conveyor belt rollers 106*b* cooperatively configure a belt conveyer that is the transfer path for transferring the print sheets, and control the transfer direction of the print sheet 2 during ink ejection. More specifically speaking, the conveyor belt 106*a* is formed by an endless belt with many holes, through which the drawing unit (not shown in the figure) draws air such that the print sheets are transferred sticking to the conveyor belt 106*a* by this negative pressure. The conveyor belt rollers 106*b* are driven by rotation of the transfer drive unit such as a motor (not shown in the figure). It is noted that, on a conveyor belt unit 106, there is provided an encoder 132 which detects rotation of each roller and outputs a pulse per predetermined angle to the motor of the transfer drive unit.

The BU roller 112 is located in the position opposite to the resist roller pair 111 on the paper feeding side at a predetermined distance from this resist roller pair 111. Incidentally, the resist roller pair 111 and the BU roller 112 configure a feeding means to feed the print sheet 2 to the transfer path while warping the print sheet 2.

Figure 4:
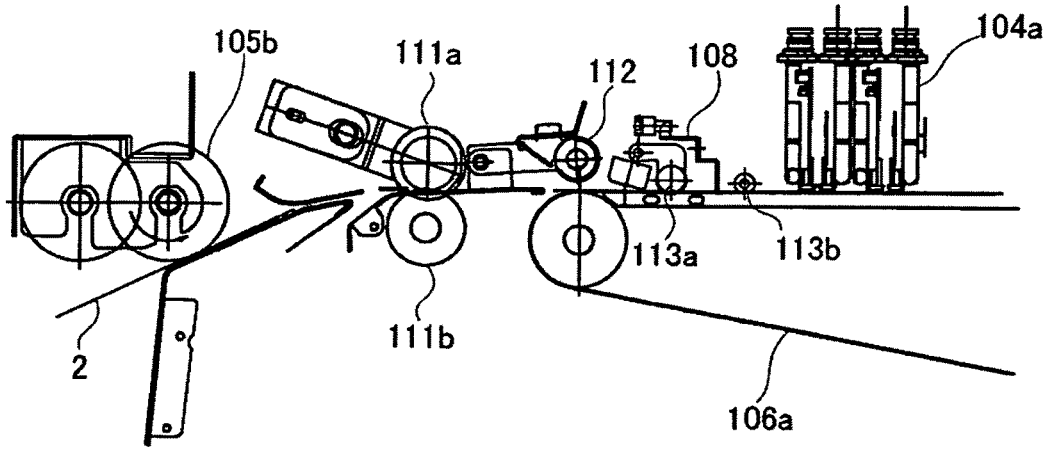
FIG. 4 is an explanatory view for showing the operation of feeding means (resist roller pair and BU roller).
Figure 4:
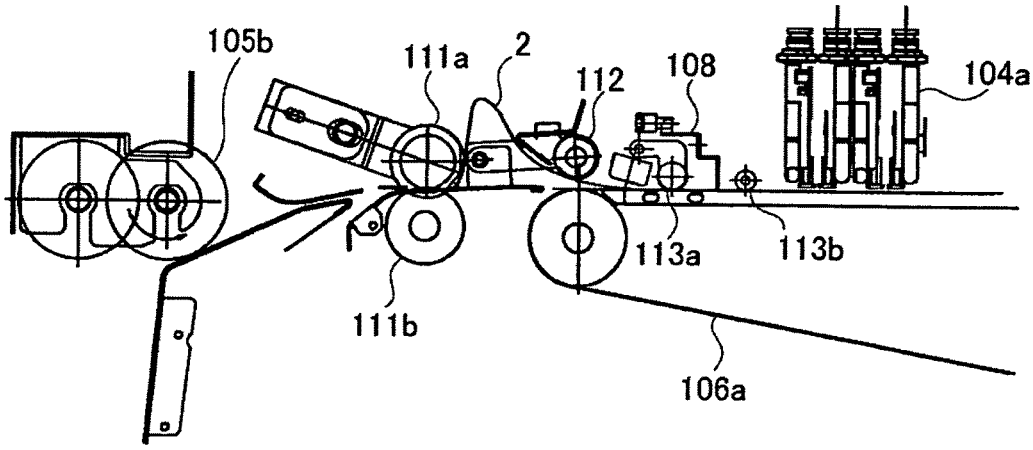

More particularly, the circumferential speed of the resist roller pair 111 is set to be higher than that of the conveyor belt 106*a*, and the print sheet 2 which is transferred from the resist roller pair 111 as shown in FIG. 4(*a*) comes in contact with the BU roller 112 at the leading edge thereof, as shown in FIG. 4(*b*) and then sticks to the conveyor belt 106*a* to follow the circumferential speed of the conveyor belt 106*a*. At this time, due to the differential circumferential speed between the resist roller pair 111 and the conveyor belt 106*a*, the print sheet 2 is warped between the resist roller pair 111 and the conveyor belt 106*a*. Meanwhile, in this case, the transfer direction of the print sheet 2 transferred from the resist roller pair 111 is regulated to the transfer direction of the conveyor belt 106*a* by the BU roller 112. The print sheet 2 transferred by the BU roller 112 is stuck to the conveyor belt 106*a* with no space by the SS roller 113*a*. Between the SS roller 113*a* and the BU roller 112, there is provided a sheet width sensor 200 which detects the width of the print sheet.

Figure 7:
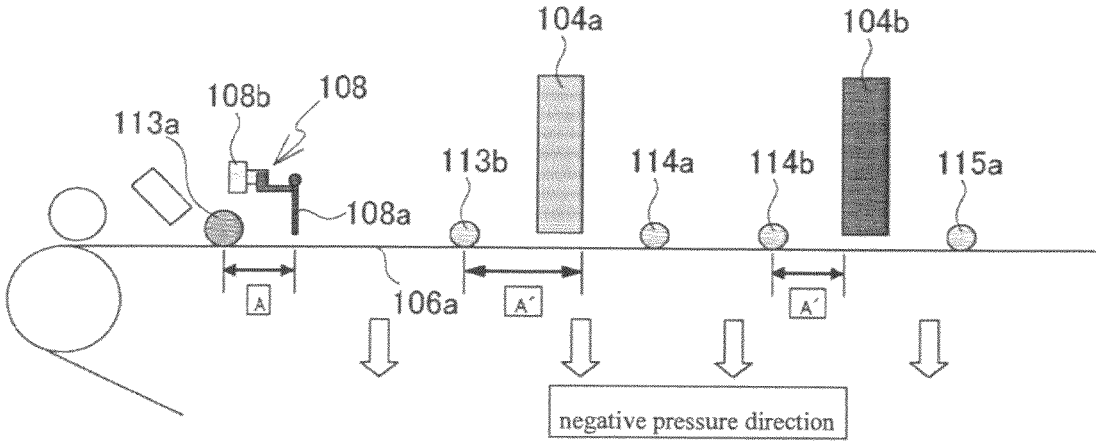
FIG. 7 is an explanatory view for schematically showing the configuration of a deformation detecting mechanism in accordance with the embodiment.

Furthermore, in the present embodiment, there is provided a deformation detecting mechanism that prevents the damage of ink jet head when a deformed print sheet is transferred. The deformation detecting mechanism is schematically shown in FIG. 7.

Figure 5:
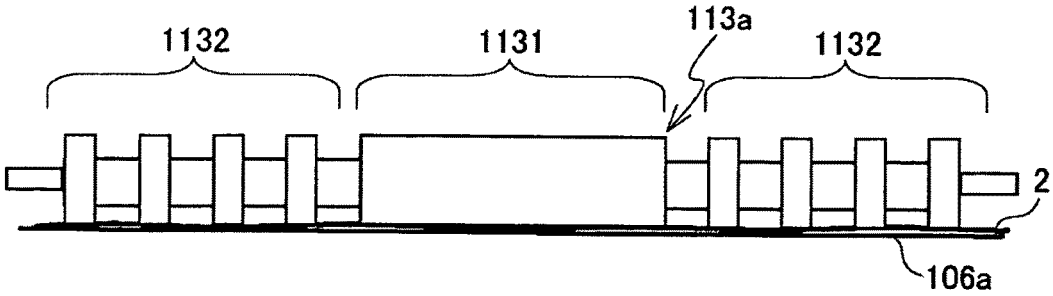
FIG. 5 is a front view for showing the configuration of an SS roller in accordance with the embodiment.

The SS roller 113*a* is a pushing roller disposed across the transfer path between the BU roller 112 and the ink jet head 104*a*, and serves to hold down the print sheet at its central position. In particular, as shown in FIG. 5, the SS roller 113*a* is formed with a central portion (print sheet holding area) 1131 having a larger diameter for holding down the central region of the print sheet and both end portions 1132 with grooves having a smaller diameter.

Figure 8:
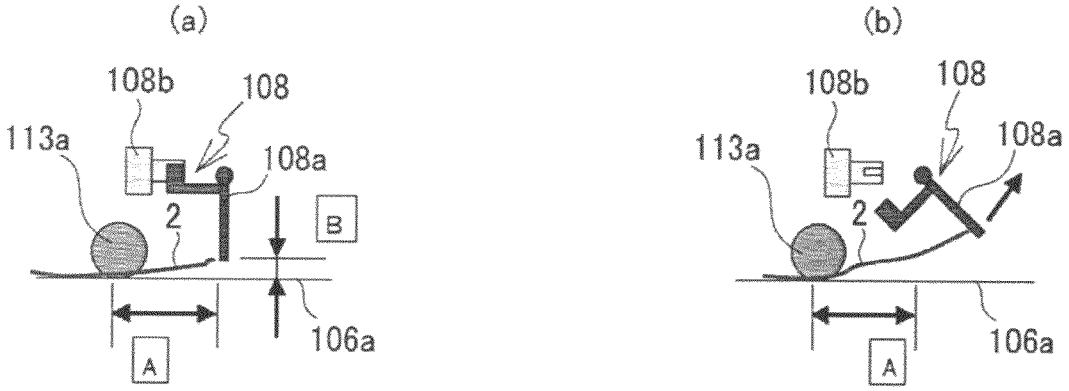
FIG. 8 is an explanatory view for showing the configuration and operation of a print sheet sensor in accordance with the embodiment.

Between the SS roller 113*a* and the ink jet head 104*a*, there is provided a print sheet sensor 108, as shown in FIG. 8, and the print sheet sensor 108 is located away from the upper surface of the conveyor belt 106*a* by a predetermined distance B. By contacting with a deformed portion of the print sheet 2 that exceeds the distance B, the print sheet sensor 108 detects the deformation of the print sheet. More specifically, the print sheet sensor 108 includes a swing member 108*a* which is crank-shaped in section and supported to swing in the transfer direction and a swing sensor member 108*b* which serves to detect the swing of the swing member 108*a*.

As has been discussed above, the lower end of the swing member 108*a* is kept away from the upper surface of the conveyor belt 106*a* by the predetermined distance B, and kept away from the SS roller 113*a* by a distance A in the transfer direction. Then, when the deformed print sheet 2 lifts up after passing through the SS roller 113*a*, the leading edge of the print sheet comes in contact with the swing member 108*a* to push forward and swing the swing member 108*a*, so that the other end of the swing member 108*a* comes off from the swing sensor member 108*b*. It is therefore possible to detect the deformation of the print sheet that exceeds the predetermined distance.

Also, between the print sheet sensor 108 and the ink jet head 104*a*, there are provided a plurality of guide rollers 113*b*, 114*a* through 117*a*, and 114*b* through 117*b* which are arranged respectively across the transfer path for holding the paper transferred on the transfer path. These guide rollers are disposed such that each of the plurality of ink jet heads is to be arranged between these guide rollers for suppressing the deformation of the print sheet in front and back of the ink jet heads 104*a* through 104*d*.

Figure 6:
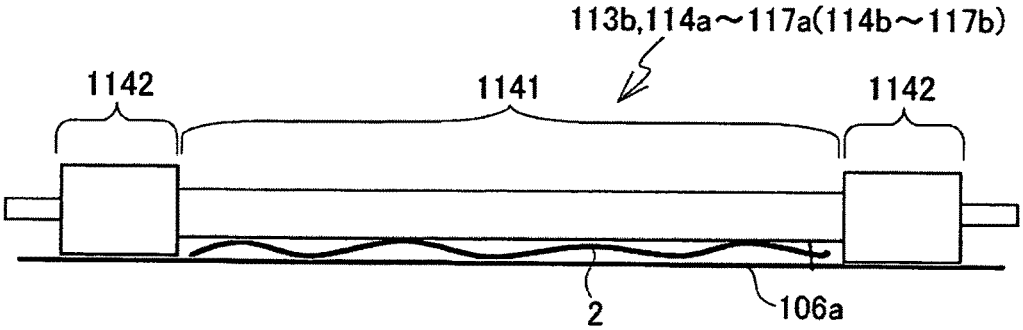
FIG. 6 is a front view for showing the configuration of a guide roller in accordance with the embodiment.
Figure 9:
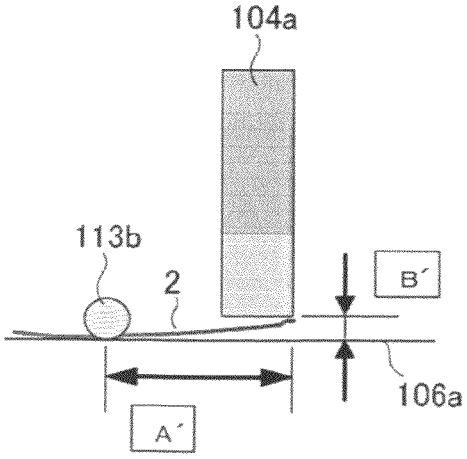
FIG. 9 is an explanatory view for showing the positional relationship between the guide roller and an ink jet head in accordance with the embodiment.

Each of these guide rollers 113*b*, 114*a* through 117*a*, and 114*b* through 117*b* is formed with both ends 1142 having a diameter larger than that of a central portion (print sheet holding area) 1141 to form a space at the central portion 1141 when the guide roller is in contact with the conveyor belt 106*a* as illustrated in FIG. 6. Incidentally, as illustrated in FIG. 9, the lower end of each of the ink jet head 104*a* through 104*d* is kept by a predetermined distance B' from the upper surface of the conveyor belt 106*a* and by a distance A' in the transfer direction from the adjacent one of the guide roller 113*b*, 114*a* through 117*a*.

Also, in the present embodiment, the ratio between a horizontal distance A from the SS roller 113*a* to the swing pat 108*a* and a vertical distance B from the upper surface of the conveyor belt 106*a* to the lower end of the swing member 108*a*, is set approximately equal to the ratio between a horizontal distance A' from the guide roller 113*b* to the ink jet head 104*a* and a vertical distance B' (head gap) from the upper surface of the conveyor belt 106*a* to the lower end of the ink jet head 104*a*.

Downstream of the conveyor belt unit 106, there is provided a sheet discharging roller 118 facing to the conveyor belt roller 106*b* on the discharging side. This sheet discharging roller 118 is provided for preventing the print sheet 2, which is transferred by the conveyor belt 106*a*, from leaving the conveyor belt 106*a* before being transferred to the sheet discharging unit 109.

(Printing Unit)

The printing unit 102 is a module for recording images on a predetermined print sheet based on a digital image signal generated by the image reading unit 101. In particular, as shown in FIGS. 1(*a*) and 2, the printing unit 102 comprises the ink jet head unit 104 for recording images by ejecting ink on the print sheet based on the digital image signal processed and output by the control unit 103, the conveyor belt unit 106 having the conveyor belt for transferring the print sheet drawn from the paper feed unit 105 to the ink jet head unit 104, and a double-side conveyor belt unit 107 for transferring the print sheet in a double-side printing mode.

The image reading unit 101 reads an original image photoelectrically by a scanner or the like and outputs digital image signals of "R", "G" and "B" components for each of the respective pixels forming the image. The digital image signals output from the image reading unit 101 are input to the control unit 103, and then the control unit 103 performs a predetermined image-processing, and the processed digital image signal is output to the printing unit 102.

The ink jet head unit 104 comprises the plurality of ink jet heads 104*a* through 104*d* located above the conveyor belt unit 106. In particular, according to the present embodiment, the ink jet head 104*b* is configured to eject ink that is darker in color than that of the ink jet head 104*a* and is disposed away from the conveyor belt 106*a* by a distance D, which is selected such that, when elastic force of the warping of the print sheet 2 is greater than adherence between the print sheet 2 and the conveyor belt 106*a*, and the print sheet 2 becomes misaligned from the conveyor belt 106*a* in the transfer direction, the print sheet does not reach the ink jet head 104*b* in the misaligned state.

The distance D as defined here can be measured, for example, as described below. Namely, distances d1 and d2 are obtained, and the above distance D can be set as a value greater than the sum of the distance d1 and d2.

The distance d1 can be obtained as follows. The distance is obtained as the distance from the conveyor belt roller 106*b* to the leading end 25 of the print sheet (this leading end position is defined as "dx") at the state (at the moment) the trailing end of the print sheet leaves the resist roller pair 111 after the difference between the circumferential speed of the resist roller pair 111 and the circumferential speed of the BU roller 112 forms warping of the print sheet between the resist roller pair 111 and the BU roller 112.

The distance d2 is obtained as follows. After the trailing end of the print sheet leaves the resist roller pair 111, the warping of the print sheet gradually diminishes. At the state before the warping diminishes completely, the print sheet does not stick to or is unlikely to stick to the conveyor belt 106*a*. In this state, the print sheet does not follow the circumferential speed of the conveyor belt 106*a*, and the elastic force of the warping of the print sheet is greater than the adherence between the print sheet and the conveyor belt 106*a*.

When the print sheet unwarps completely (the print sheet sticks to the conveyor belt 106*a* completely), the print sheet follows the circumferential speed of the conveyor belt 106*a* (the elastic force of warping of the print sheet is smaller than the adherence between the print sheet and the conveyor belt 106*a*). At this moment, obtain the distance d2 from the above position dx to the leading end of the print sheet. Meanwhile, the leading end of the print sheet corresponds to a position where the print sheet reaches when the elastic force of warping the print sheet becomes greater than the above adherence, so that the print sheet is misaligned from the conveyor belt 106*a* in the transfer direction.

Also, the ink jet head 104*a* is disposed between the BU roller 112, which is providing means, and the ink jet head 104*b*.

Specifically, these ink jet heads 104*a* through 104*d* correspond to respective "C", "K", "M", and "Y" components of digital image in sequence from the feeding end, and each ink jet head 104*a* through 104*d* has two head units.

Incidentally, each head unit has ink outlet ports which are arranged in two lines L1 through L3 at a pitch of 150 dpi in the X-axis direction (in the direction perpendicular to the transfer direction of the print sheet) as illustrated in FIG. 1(*c*). Each of the ink jet heads 104*a* through 104*d* provides ink outlet ports at a pitch of 300 dpi in the X-axis direction by combining the two head units configured as described above.

At each lower end of the ink jet heads 104*a* through 104*d*, there are provided a plurality of nozzles aligned at a predetermined distance with their ink jet nozzles downward. Inside each ink jet head, there is provided an ink chamber (where an ink tank provides ink) communicating with each nozzle and having a piezoelectric element (piezo crystal) therein.

The piezoelectric element is driven by a jet control signal from the control unit 103 to change pressure within the ink chamber, so that the nozzle ejects ink. By ejecting ink droplet downward from the ink jet nozzles, the ink jet head unit 104 applies ink on an upper surface of the print sheet just below the corresponding ink jet head.

(Sheet Discharging Unit)

The sheet discharging unit 109 has a transfer selecting unit 109*a*, a discharging roller pair 109*b*, and a sheet discharging tray 109*c*.

In response to a driving signal from the control unit 103, the transfer selecting unit 109*a* moves its left end upward to lead the print sheet 2 transferred by the conveyor belt 106 to the sheet discharging unit 109, or moves its end downward to lead the print sheet 2 to the double-side conveyor belt unit 107. In the forward direction of transmitting print sheets as seen from the conveyor belt roller 106*b* on the paper discharging side, there is provided a paper discharging path for guiding the print sheet the discharging roller pair 109*b*. The circumferential speed of the discharging roller pair 109*b* is set faster than that of the conveyor belt 106*a*. The print sheet 2 transferred by the conveyor belt 106*a* is therefore accelerated by the discharging roller pair 109*b* to be stored on the sheet discharging tray 109*c*.

The double-side conveyor belt unit 107 is formed by an endless belt 107*a* to transfer the print sheet, which is printed on one side, to the printing unit 102 through a reverse path 122. The reverse path 122 is provided with a path selecting unit 123. The path selecting unit 123 enables to send the print sheet, transferred from the double-side conveyor belt unit 107 through a transfer path 121, to and from the reverse path 122 so that its unprinted surface is turned up, and then send the turned-up sheet to the printing unit 102.

(Control Unit)

Figure 3:
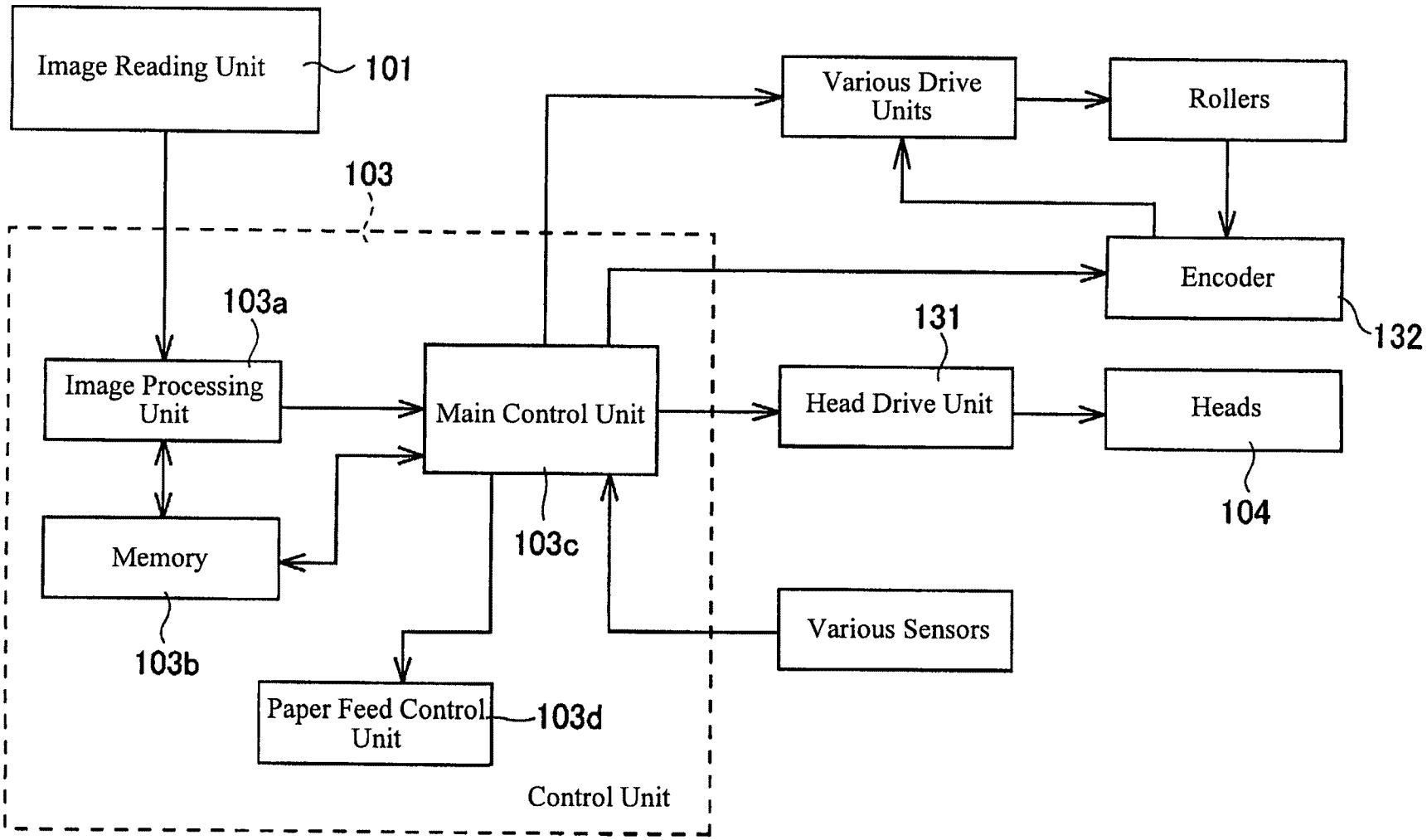
FIG. 3 is a block diagram for showing the structure of the control unit in accordance with the embodiment.

FIG. 3 is a block diagram for showing the structure of the control unit 103. The control unit 103 is connected to a PC (not shown in the figure) to which detected signals are input from various sensors. According to the detected signals, the control unit 103 controls each driving unit which drives rotation of each roller, a head drive unit 131 which drives ink jet ejecting operation of each ink jet head 104*a* through 104*d*, the transfer selecting unit 109*a*, and the path selecting unit 123.

Specifically speaking, the control unit 103 comprises: an image processing unit 103*a* which performs image-processing on the digital image signal input from the image reading unit 101; a memory 103*b* serving as a storage device; a paper feed control unit 103*d* controlling the feeding motion of the paper feed unit 105; and a main control unit 103*c* controlling each unit in response to signals from each sensor.

The image processing unit 103*a* converts digital image signals of R, G and B components of one image, which are output from the image reading unit 101, into digital image signals of Y (yellow), M (magenta), C (cyan), and K (black) components. The image processing unit 103*a* further converts each value of Y, M, C, and K components for each pixel of the digital image signals into ink amount data which is used when ejecting ink, and saves the data in the memory 103*b*. For example, the ink amount data in the image processing unit 103*a* includes the data corresponds to an ink ejection amount of each nozzle of each head (for example, the number of times of ejecting ink when the ejection amount from a nozzle is kept constant). The ink amount data also includes, related to each head, the number of rotation pulses from the time of detection by the print sheet sensor 108. Incidentally, the ink amount data is created for each image (of both sides) and deleted by the main control unit after the printing process is completed, for instance.

The main control unit 103*c* detects rotation of each roller by sensors provided on the conveyor belt unit 106, and performs controlling of each driving unit cooperatively with the encoder 132 which outputs pulse for a predetermined angle to the driving unit.

(Operation of Ink Jet Printer)

The operation of the ink jet printer having the structure as described above is as follows.

First, a user specifies a double-side printing or a single-side printing on the PC (not shown in the figure). The specified information is sent to the control unit 103. It is assumed here that the single-side printing is specified. The main control unit 103*c* drives the transfer select unit 109*a* to move its left end upward.

Next, when the user performs a print start operation, the image reading unit 101 executes an image reading process, and according to the above described converting process, the ink amount data is saved in the memory 103*b*.

The main control unit 103*c* drives the driving side of the electromagnetic clutch 1058 to rotate through the drive transmission belt 1057 of the paper feed unit 105, synchronizing with driving units of respective units by the encoder 132. At the same time, the main control unit 103*c* provides a paper feed signal to the paper feed control unit 103*d* to start applying current to the electromagnetic clutch 1058 in response to the signal output from the paper feed timing sensor 202.

When applying current to the electromagnetic clutch 1058 is started, driving force of the driving side is transmitted to the driven side of the electromagnetic clutch 1058, so that the paper feed roller 105*b* is driven to rotate. With rotation of the paper feed roller 105*b*, the print sheet 2 at the top of the paper feed tray 105*a* is picked up, and fed and transferred along the lower guide plate toward the resist roller pair 111.

The main control unit 103*c* also instructs the driving unit for driving each roller to drive each roller to rotate. In particular, the main control unit 103*c* instructs the resist roller pair 111, the conveyor belt roller 106*b*, and the sheet discharging roller 118 to rotate (the circumferential speed of this roller 118 is much greater than that of the resist roller pair 111 and that of the conveyor belt roller 106*b*) at the above predetermined velocity.

Meanwhile, when a plurality of overlapped print sheets are picked up at once from the paper feed roller 105*b*, difference between: the frictional resistance between the print sheets; and the frictional resistance between the print sheet and the paper separation pad holder; enables to transfer only a top sheet toward the resist roller pair 111.

The difference between the circumferential speed of the resist roller pair 111 and the circumferential speed of the conveyor belt 106*a* forms warping, between the resist roller pair 111 and the conveyor belt 106*a*, of the print sheet 2 sent from the resist roller pair 111. The transfer direction of the print sheet 2 is corrected to the transfer direction of the conveyor belt 106*b* by the BU roller 112. The print sheet 2 regulated in the transfer direction by the BU roller 112 is then sent to the SS roller 113*a*, which presses the central deformation of the print sheet 2, which is then sent to the print sheet sensor 108.

When the deformed print sheet 2 comes to lift after passing through the SS roller 113*a*, the leading end of the print sheet contacts with the swing member 108*a* of the print sheet 2 sensor 108. The swing member 108*a* is pushed forward to swing, so that the other end of the swing member 108*a* drops off from the swing sensor member 108*b*. Thereby, it is detected that the deformation of the print sheet exceeds the predetermined volume. When the print sheet sensor 108 detects the deformation of the print sheet 2, the detection signal is sent to the main control unit 103*c*. The main control unit 103*c* instructs each driving unit to stop the rotation of each roller for a predetermined time. The print sheet 2 that passes through the print sheet sensor 108 without being detected of deformation is pressed by the SS roller 113*a* and then sent to the ink jet head unit 104.

The main control unit 103*c* obtains pulse signals output from the encoder 132, and then starts counting. Also, the main control unit 103*c* determines which nozzle performs ink ejection and which nozzle does not for each head, depending on the width of the print sheet detected by the sensor, and gives instructions to the head drive unit 131. The main control unit 103*c* also refers to the ink amount data, and when the count number reaches that of the ink jet head at the left end, makes each nozzle perform ink ejection for the number of times recorded as the ink amount data by the head drive unit 131. This is performed at each ink jet head every time the count number reaches that of each ink jet head.

The print sheet 2 on which each ink jet head applied ink is sent to the sheet discharging tray 109*c* through the conveyor belt roller, the sheet discharging roller 118 on the discharging side, the discharging path; and the discharging roller pair 109*b*.

Meanwhile, when the double-side printing is specified by the user, the left end of the transfer selecting unit 109*a* is moved downward. Then, the transfer selecting unit 109*a* enables to transfer the print sheet 2 on which each head applied ink, to the double-side conveyor belt unit 107 by the roller pair 120*a* and 120*b* on the transfer path 120. The print sheet 2 is then turned up through the reverse path 122 so that the ink applied surface faces downward, and sent again to the resist roller pair 111 by each roller 124*a*, 124*b*. The subsequent operations are same as described above.

Effects and Advantages

Figure 10:
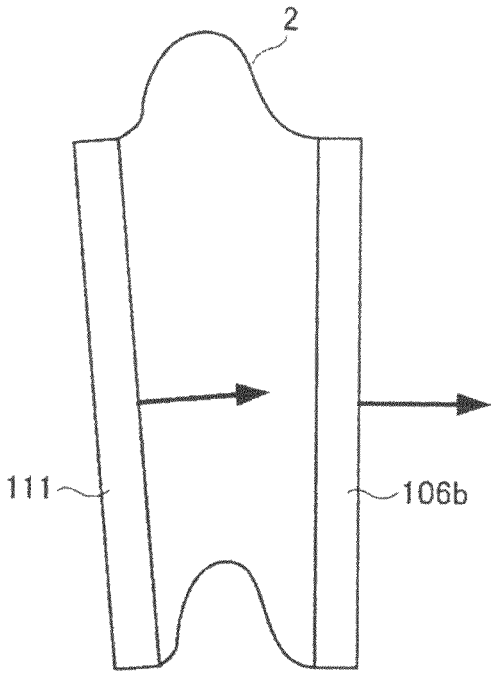
FIG. 10 is an explanatory view for schematically showing the mechanism of warping the print sheet.

As has been discussed above, in accordance with the present embodiment, it is possible to prevent the damage or the like of the print sheets while realizing the high-speed printing, since the transfer direction is corrected by warping the print sheet 2 and then absorbing or releasing the tension acting on the print sheet 2. More particularly, it is difficult to assemble the BU roller 112 and the resist roller pair 111 absolutely in parallel due to limitation of accuracy of the assembly, such that, as shown in FIG. 10, the print sheet slides in the transfer direction because the rollers are not parallel. In accordance with the present embodiment, it is possible to correct the transfer direction by warping the print sheet 2 between the rollers and absorbing or releasing the tension acting on the print sheet 2.

Also, in accordance with the present embodiment, since the ink jet head 104*b* with dark-colored ink (in this case, black ink) deeper than that of the ink jet head 104*a*, is arranged at a position away from a reaching position where the print sheet 2 reaches after released from the warping, even if the misalignment is caused because the elastic force of the warping of print sheet 2 is greater than the adherence between the print sheet 2 and the conveyor belt 106*a* so that the print sheet is misaligned from the conveyor belt 106*a* in the transfer direction, only a light-colored ink ejected by the ink jet head 104*a* is influenced but dark-colored ink is not influenced. Accordingly, it is possible to minimize debasement of the quality of printing. Furthermore, in accordance with the present embodiment, it is possible to miniaturize the device since the paper feed unit 105 is put closer to the ink jet head unit 104.

Prevention of the debasement of the printing quality will be described in detail. In the case of the present embodiment, the ink jet head 104*a* at the left most end is provided with the light-colored ink other than black. Printing with the light-colored ink by the ink jet head 104*a* becomes a base, on which printing with the dark-colored ink by the ink jet head 104*b* is performed. As described above, when the print sheet 2 is in the misaligned state after released from the warping, only the printing position of the underlying light-colored ink other than the black ink is misaligned, and the printing position of the dark-colored ink is not misaligned.

Figure 12:
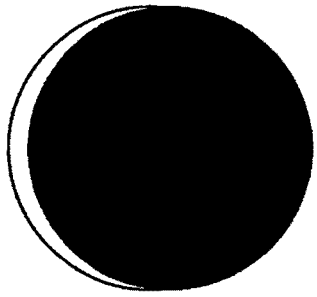
FIG. 12 is an explanatory view for showing the difference in effects and advantages due to the order of printing inks.
Figure 12:
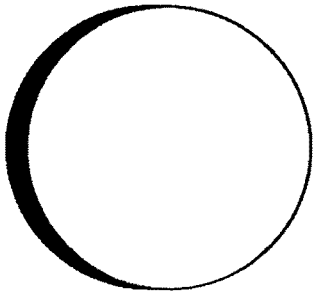

As a result, when at least two colors out of four, one other than black on the paper feed end and black, are used, it is hard to discover dot misalignment when using two colors out of four where one color is a color other than black for the head at the paper feed end and the other being black for another head. Namely, it is hard to recognize the dot alignment when the dark-colored (black) ink is applied on the light-colored ink (refer to FIG. 12) than when the light-colored ink other than the black ink is applied on the black ink.

This is because of a visual effect of human beings where a dark-colored part tends to catch eyes and to be recognized with emphasis. When a dark-colored area is wider than a light-colored area in an area, the dark-colored area draws attention. Moreover, even though the light-colored area is wider than the dark-colored area, the dark-colored area draws attention. Accordingly, the light-colored area corresponding to the misalignment is narrower than a dark-colored area, so that it is not easy to be recognized the light-colored area.

Near the resist roller pair 111 or the discharging roller pair 109*b*, paper dust is often generated when these rollers rub against the surface of print sheets. The paper dust is easy to stick to the recording heads (the ink jet head 104*a* near the resist roller pair 111 and the conveyor belt roller 106*b*) near the paper•feed•end and the recording heads (ink jet head 104*d* near the discharging roller pair 109*b* and the conveyor belt roller 106*b*) near the sheet discharging end. When the recording heads on the paper feed end and the recording heads on the sheet discharging end eject black ink on the print sheets, white is easy to be discovered in the black-colored image, thereby giving substantially influence on images on the print sheets. In accordance with the present embodiment, since colored ink other than black (light-colored ink such as Y) is arranged as the recording heads at the paper feed end and the recording heads at the sheet discharging end, it is possible to lower the influence on the print sheets even though the paper dust sticks to these heads, compared to arranging black-colored ink jet head on the paper feed end or the sheet discharging end.

Accordingly, in accordance with the present embodiment, it is possible to realize high-speed printing with ink jet heads and miniaturization of device, while preventing debasement of the printing quality caused by the misaligned ink position and the paper dust generated during feeding paper.

Furthermore, in accordance with the present embodiment, it is possible to prevent the harmful results due to the print sheet 2 coming in contact with the ink jet head 104*a* by providing the print sheet sensor 108 upstream of the ink jet head 104*a*, detecting contact with the print sheet having deformation volume over the predetermined volume by the sensor, and stopping the printing in response to the detection.

Particularly, in accordance with the present embodiment, since the ratio between the horizontal distance A from the SS roller 113*a* to the detecting part and the vertical distance B from the upper surface of the conveyor belt 106*a* to the lower end of the print sheet sensor 108, is set approximately equal to the ratio between the horizontal distance A' from the guide roller 113*b* to the ink jet head and the vertical distance B' from the upper surface of the conveyor belt 106*a* to the lower end of the ink jet head, it is possible to realize high-accuracy detection. That is, the deformation of the print sheet which is pressed by the SS roller 113*a* increases in proportion to the distance from the SS roller 113*a* toward the downstream, it is determined whether or not the print sheet passing through the guide roller 113*b* comes in contact with the ink jet head 104*a* on the basis of the positional relationship between the SS roller 113*a* and the print sheet sensor 108 at the upstream of the ink jet head 104*a*. Thereby, it is possible to prevent debasement of the quality of printing due to the print sheet which is deformed, the damage of the ink jet head, blocking of ink ejection and so forth.

Also, in accordance with the present embodiment, the guide roller 113*b* has a larger diameter at both ends (area other than sheet pressing area), and rolls with both ends contacting with the conveyor belt 106*a*. This enables the deformed print sheet to be rolled by the rotation of guide roller 113*b*, thereby stabilizing the transfer. On the other hand, the guide roller 113*b* has a smaller diameter at the sheet pressing area so as to prevent the print sheet 2 from coming in contact with the rollers and being tainted. The deformation of print sheets is usually not at the printing part but mainly at their edge, such as curl. Since printing is not performed on the edge, the printing part is not taint damaged even though the printed sheet is rolled in the downstream of the ink jet head 104*a*.

Figure 11:
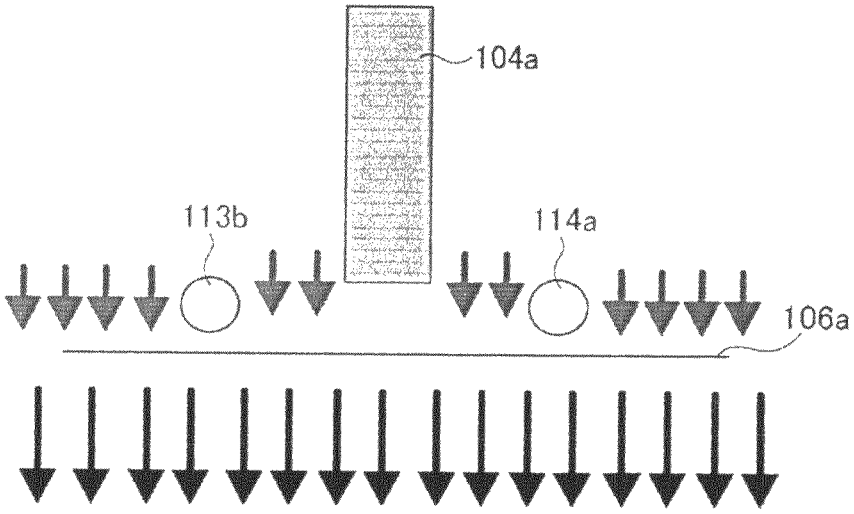
FIG. 11 is an explanatory view for showing airflow near the ink jet head in the embodiment.

Furthermore, in accordance with the present embodiment, since the guide rollers 113*b* through 113*b* and 114*b* through 117*b* are arranged as roller pairs having each ink jet head between them, the conditions of pressing the print sheets is kept approximately equal at the upstream and downstream of each ink jet head. This enables to prevent biased tension from acting on the print sheets 2. As shown in FIG. 11, airflow around the ink jet head 104*a* is made simple to a maximum extent to reduce a rapid change of airflow, thereby preventing stains of fine ink in ejection by making the conveyance structure of the print sheet 2 as simple as possible.

Modification Examples

Incidentally, the present invention is not limited to the above embodiment, but it is possible to add the following modification.

For example, the number of ink jet heads is not limited to four but may be any other number. The position of the recording head with black ink may be arranged closer to the sheet discharging end than the second position from the paper feed end. The positions of recording heads with colored-ink other than black may be selected to other positions than as described above.

Furthermore, it is also possible to set the recording head at the sheet discharging end (head at the right most end) with black ink and the recording head at the paper feed end with colored-ink other than black. In this case, although not accomplishing the advantage that paper dust is prevented from sticking to the ink ejecting port since paper dust is scattered by the rubbing action and the like of the discharging roller on the print sheet, the other advantages are realized as described above.

Also, in accordance with the present embodiment, although the transfer of the print sheet 2 is stopped when the deformation of the print sheet 2 is detected, it is possible to provide a discharging path for discharging the print sheet from the transfer path upstream of the ink jet head 104*a*, discharge the print sheet when the deformation is detected without stopping the printing, re-transfer a new print sheet, and perform printing on the new sheet.

INDUSTRIAL APPLICABILITY

As has been discussed above, in accordance with the present invention, the high-speed printing can be realized, while keeping the printing quality, by warping the print sheet and then absorbing or releasing the tension acting on the print sheet to correct the transfer direction, and it is possible to keep the printing quality by limiting the influence of print sheet misalignment on dark-colored ink, while miniaturizing the device, by locating the paper feed unit close to the first ink jet head.

The invention claimed is:

1. An ink jet printer comprising:

a conveyor belt unit including a rotating conveyor belt which serves to form a transfer path of a print sheet with a predetermined size;

a feed unit configured to warp the print sheet in a transfer direction in a manner that spaces the print sheet from the transfer path and feed the print sheet onto the transfer path in a manner that releases the warp of the print sheet; and first and second ink jet heads disposed along the transfer path in succession and configured to perform ink ejection on the print sheet passing through the transfer path, wherein the second ink jet head is configured to eject an ink which is darker in color than that of the first ink jet head, wherein the first ink jet head is located at a first position adjacent to the feed unit and the second ink jet head is located at a second position adjacent to the first ink jet head in the transfer direction, wherein the first position is a position having a distance less than the size of the print sheet from a position of the feed unit in the transfer direction, wherein the second position is a position having a distance more than the size of the print sheet from a position of the feed unit in the transfer direction, and wherein the predetermined size includes one of A4 size, A3 size, B4 size, B5 size, Statement size, Half Letter size, Executive size, Letter size and Legal size.

2. The ink jet printer as claimed in claim 1, wherein the feed unit comprises two pairs of rollers which are arranged along the transfer direction, and wherein the feed unit is configured to warp the print sheet in a manner that spaces the print sheet from the transfer path by the differential circumferential speed between the two roller pairs.

3. The ink jet printer as claimed in claim 1, wherein the ink ejected by the second ink jet head is black.

4. The ink jet printer as claimed in claim 1, further including a warp detecting unit configured to detect the warp of the print sheet having a deformation over a predetermined value in an area between the feeding unit and the first ink jet head.

5. The ink jet printer as claimed in claim 1, further comprising:

a plurality of ink jet heads in addition to the first and second ink jet heads, wherein the feed unit, the first and second ink jet heads, and the plurality of ink jet heads are arranged in order of the feed unit, the first ink jet head, the second ink jet head, and the plurality of ink jet heads in the transfer direction.

6. The ink jet printer as claimed in claim 1, wherein the second position is a position where a front end edge of the print sheet reaches when the warp of the print sheet is fully released or a position further than the position.

7. An ink jet printing method adopted to a ink jet printer comprising a feed unit for feeding a print sheet, a first ink jet head and a second ink jet head, the ink jet printing method comprising:

warping a print sheet with a predetermined size in a transfer direction in a manner that spaces the print sheet from the transfer path and feeding the print sheet onto a transfer path, which is formed by a rotating conveyor belt, by the feed unit;

ejecting ink from a first ink jet head, on the print sheet, with a state in which the warp of the print sheet is being released, passing through the transfer path; and ejecting ink from a second ink jet head, on the print sheet passing through the transfer path, wherein the second ink jet head is configured to eject an ink which is darker in color than that of the first ink jet head, wherein the first ink jet head is located at a first position adjacent to the feed unit and the second ink jet head is located at a second position adjacent to the first ink jet head in the transfer direction, wherein the first position is a position having a distance less than the size of the print sheet from a position of the feed unit in the transfer direction, wherein the second position is a position having a distance more than the size of the print sheet from a position of the feed unit in the transfer direction, and wherein the predetermined size includes one of A4 size, A3 size, B4 size, B5 size, Statement size, Half Letter size, Executive size, Letter size and Legal size.

8. The ink jet printing method as claimed in claim 7, wherein, in feeding the print sheet onto the transfer path, the print sheet is warped by two pairs of rollers, which are arranged along the transfer direction and circulated at different circumferential speeds, in a manner that spaces the print sheet from the transfer path.

9. The ink jet printing method as claimed in claim 7, wherein the ink ejected by the second ink jet head is black.

10. The ink jet printing method as claimed in claim 7, further including detecting the warp of the print sheet having a deformation over a predetermined value in an area between the feeding unit and the first ink jet head.

11. The ink jet printing method as claimed in claim 7, wherein the ink jet printer further comprises a plurality of ink jet heads in addition to the first and second ink jet heads, wherein the feed unit, the first and second ink jet heads, and the plurality of ink jet heads are arranged in order of the feed unit, the first ink jet head, the second ink jet head, and the plurality of ink jet heads in the transfer direction.

12. The ink jet printing method as claimed in claim 7, wherein the second position is a position where a front end edge of the print sheet reaches when the warp of the print sheet is fully released or a position further than the position.

* * * * *